US010495036B2

(12) United States Patent
Kim

(10) Patent No.: US 10,495,036 B2
(45) Date of Patent: Dec. 3, 2019

(54) EGR COOLER FOR VEHICLE

(71) Applicants: Hyundai Motor Company, Seoul (KR); Kia Motors Corporation, Seoul (KR)

(72) Inventor: Jong Cheon Kim, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/013,013

(22) Filed: Jun. 20, 2018

(65) Prior Publication Data

US 2019/0186432 A1 Jun. 20, 2019

(30) Foreign Application Priority Data

Dec. 20, 2017 (KR) ..... 10-2017-0175990

(51) Int. Cl.
*F02M 26/32* (2016.01)
*F02M 26/30* (2016.01)
(Continued)

(52) U.S. Cl.
CPC ..... *F02M 26/32* (2016.02); *F02M 26/28* (2016.02); *F02M 26/30* (2016.02); *F28D 7/10* (2013.01);
(Continued)

(58) Field of Classification Search
CPC ..... F02M 26/32; F02M 26/28; F02M 26/30; F28D 7/1684; F28D 7/10; F28F 21/08; F28F 2280/08; F28F 2230/00; F28F 2265/26; F28F 2275/06; F28F 2275/04; F28F 21/089; F28F 21/084
See application file for complete search history.

(56) References Cited

U.S. PATENT DOCUMENTS

2002/0162651 A1* 11/2002 Nakagome ..... F28F 9/0229 165/158
2003/0070793 A1* 4/2003 Dierbeck ..... F28D 9/0081 165/145

(Continued)

FOREIGN PATENT DOCUMENTS

KR 100814071 B1 * 3/2008 ..... F28D 7/1684
WO WO-2008105576 A1 * 9/2008 ..... F28D 7/1684

*Primary Examiner* — Joseph J Dallo
(74) *Attorney, Agent, or Firm* — Morgan, Lewis & Bockius LLP

(57) ABSTRACT

An exhaust gas recirculation (EGR) cooler may include a housing forming the receiving space and in which a coolant inflow hole and a coolant exhaust hole are respectively formed so that a coolant of the cylinder block flows into and out, a cover plate mounted on the housing to close the receiving space and in which an exhaust gas inflow hole and an exhaust gas outflow hole are respectively formed so that an exhaust gas flows into and out, a core including both side caps in which a penetration hole respectively connected to the exhaust gas inflow hole and the exhaust gas outflow hole in the receiving space and a tube through which the exhaust gas communicates while connecting both the side caps to each other, and a connector respectively connecting the penetration hole of the cap to the exhaust gas inflow hole and the exhaust gas outflow hole of the cover plate.

19 Claims, 4 Drawing Sheets

(51) Int. Cl.

| | |
|---|---|
| ***F02M 26/28*** | (2016.01) |
| ***F28D 7/10*** | (2006.01) |
| ***F28D 7/16*** | (2006.01) |
| *F28F 21/08* | (2006.01) |

(52) U.S. Cl.
CPC ..... *F28D 7/1684* (2013.01); *F28F 21/08* (2013.01); *F28F 21/084* (2013.01); *F28F 21/089* (2013.01); *F28F 2230/00* (2013.01); *F28F 2265/26* (2013.01); *F28F 2275/04* (2013.01); *F28F 2275/06* (2013.01); *F28F 2280/08* (2013.01)

(56) References Cited

U.S. PATENT DOCUMENTS

| | | | | |
|---|---|---|---|---|
| 2004/0256086 | A1* | 12/2004 | Brost | F01N 5/02 165/80.4 |
| 2005/0056411 | A1* | 3/2005 | Dilley | F28D 9/0018 165/167 |
| 2008/0251242 | A1* | 10/2008 | Irmler | F28D 9/0043 165/164 |
| 2008/0289611 | A1* | 11/2008 | Modien | F02M 26/26 123/568.12 |
| 2010/0154758 | A1* | 6/2010 | Schneider | G01F 1/44 123/568.12 |
| 2014/0202403 | A1* | 7/2014 | Maki | F01P 11/08 123/41.33 |

* cited by examiner

EGR COOLER FOR VEHICLE

CROSS-REFERENCE TO RELATED APPLICATION

The present application claims priority to Korean Patent Application No. 10-2017-0175990 filed on Dec. 20, 2017, the entire contents of which are incorporated herein by reference.

BACKGROUND OF THE INVENTION

Field of the Invention

The present invention relates to an EGR cooler for a vehicle. More particularly, the present invention relates to an EGR cooler for a vehicle capable of being inserted at one side of a cylinder block.

Description of Related Art

Exhaust gases of vehicles include harmful substances such as carbon monoxide (CO), nitrogen oxide (NOx), hydrocarbon (HC), etc.

Various technologies have been developed to reduce the exhaust gas by regulating exhaust gases including harmful substances through related laws.

One of them is an exhaust gas recirculation (hereinafter referred to as "EGR").

The EGR executes a function of reducing a discharge of the harmful substances such as nitrogen oxides by absorbing a part of the exhaust gas of the vehicle together with the mixer to lower the temperature of the combustion chamber.

In detail, the EGR is a device recirculating the exhaust gas among the discharge gases into an intake system to lower the combust temperature inside the cylinder to suppress a generation of nitrogen oxide.

Among the configurations of the EGR, the EGR cooler is a kind of a heat exchanger which cools the exhaust gas of high temperature with a coolant of an engine cooling water.

The EGR cooler is assembled through a separate housing outside the cylinder block to be mounted at one side of an engine compartment.

This EGR cooler may include a housing in which a coolant inflow pipe and a coolant outflow pipe are provided at both sides and a plurality of tubes disposed to be parallel along a longitudinal direction inside the housing, and is connected to an exhaust gas line.

Accordingly, the cooling water supplied through the coolant inflow pipe exchanges heat with the exhaust gas flowing along the tubes inside the housing, and the cooling water after completing the heat exchange may cool the exhaust gas of high temperature with a recirculation system in which the cooling water is discharged through a cooling water outflow pipe.

However, the conventional EGR cooler as described above requires a separate space to be disposed inside the engine compartment, which not only increases the cost but also has a drawback in which the weight increases.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an EGR cooler for a vehicle which may reduce a occupied space in the engine compartment by integrally forming and mounting the housing at one side of the cylinder block, thereby realizing a low weight and a cost reduction.

Various aspects of the present invention are directed to providing an EGR cooler for a vehicle configured for reducing a number of parts and realizing the low weight by integrally forming a bracket to bond the exhaust gas line to a cover plate.

Various aspects of the present invention are directed to providing an EGR cooler for a vehicle for preventing a corrosion of the cover plate for the exhaust gas and a condensed water and improving a durability and a connectivity by applying a connector to mutually bond a cover plate of an aluminum material and a cap of a stainless material.

An EGR cooler for a vehicle according to an exemplary embodiment of the present invention as an EGR cooler for a vehicle disposed at a receiving space formed on one side wall surface of a cylinder block of a vehicle may include a housing forming the receiving space and in which a coolant inflow hole and a coolant exhaust hole are respectively formed so that a coolant of the cylinder block flows into and out; a cover plate mounted on the housing to close the receiving space and in which an exhaust gas inflow hole and an exhaust gas outflow hole are respectively formed so that an exhaust gas flows into and out; a core including both side caps in which a penetration hole respectively connected to the exhaust gas inflow hole and the exhaust gas outflow hole in the receiving space and a tube through which the exhaust gas communicates while connecting both the side caps to each other; and a connector respectively connecting the penetration hole of the cap to the exhaust gas inflow hole and the exhaust gas outflow hole of the cover plate.

The cover plate may include an aluminum material.

The cover plate may be bonded with the cap in a state that a plain end portion thereof is formed to be protruded at both sides of an internal surface and the exhaust gas inflow hole and the exhaust gas outflow hole are formed to be penetrated at the plain end portion.

Both the side cap may be mounted inside the cover plate, the penetration hole is respectively formed corresponding to the exhaust gas inflow hole and the exhaust gas outflow hole, and the tube may be disposed between both side caps and including a plurality of layers forming an exhaust gas passage inside.

The connector may include a first pipe portion bonded to an internal circumference in a state of being respectively inserted into the exhaust gas inflow hole and the exhaust gas outflow hole of the cover plate; a second pipe portion bonded to an internal circumference in a state of being inserted to the penetration hole of the cap; and a flange portion integrally connecting the first and second pipe parts and located between the cover plate and the cap.

The flange portion maybe formed to have an external diameter greater than an external diameter of the first and second pipe parts.

The connector may be plated with a nickel-zinc (Ni—Zn) alloy on an external surface.

An aluminum filler metal may be coated on the external circumference of the first pipe portion in contact with the cover plate and a partial surface of the flange portion in contact with the cover plate.

A nickel filler metal may be coated on the external circumference of the second pipe portion in contact with the cap and a partial surface of the flange portion in contact with the cap.

The connector may be welding-bonded with the cover plate and the cap through a braze process.

According to an exemplary embodiment of the present invention, as the housing is integrally formed to be mounted at one side of the cylinder block, an occupied space in an engine compartment may be reduced, thereby there are effects that a low weight and a cost reduction are possible.

Also, as an exemplary embodiment of the present invention integrally forms the bracket for bonding the exhaust gas line at the cover plate, the number of parts may be reduced and a low weight may be realized.

Also, in an exemplary embodiment of the present invention, by applying the connector for bonding the cover plate of the aluminum material and the cap of the stainless material, the corrosion of the cover plate against the exhaust gas and the condensed water may be prevented and a durability and a connectivity may be improved.

Furthermore, effects which may be obtained or expected from exemplary embodiments of the present invention are directly or suggestively described in the following detailed description. That is, various effects expected from exemplary embodiments of the present invention will be described in the following detailed description.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
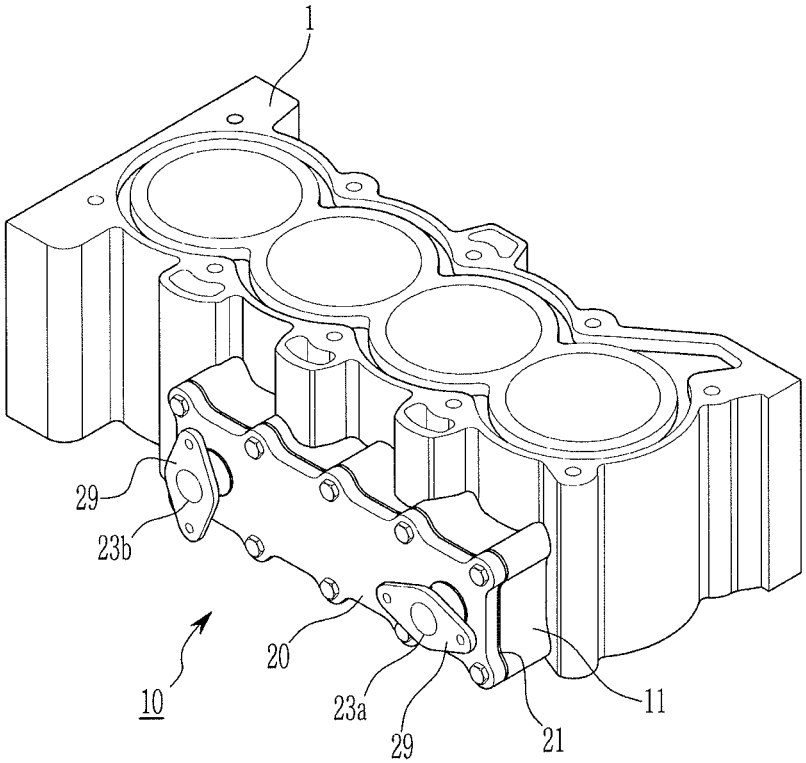
FIG. 1 is a mounting perspective view of an EGR cooler for a vehicle according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will be described more fully hereinafter with reference to the accompanying drawings, in which exemplary embodiments of the present invention are shown. As those skilled in the art would realize, the described embodiments may be modified in various different ways, all without departing from the spirit or scope of the present invention.

The drawings and description are to be regarded as illustrative in nature and not restrictive, and like reference numerals designate like elements throughout the specification.

In the following description, dividing names of components into first, second and the like is to divide the names because the names of the components are the same as each other and an order thereof is not particularly limited.

Figure 2:
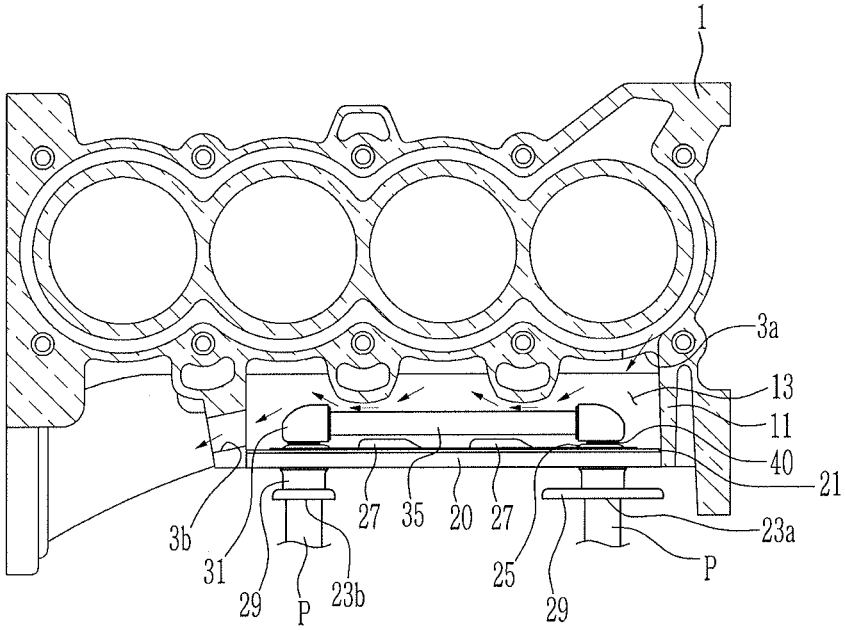
FIG. 2 is a schematic mounting cross-sectional view of an EGR cooler for a vehicle according to an exemplary embodiment of the present invention.
Figure 3:
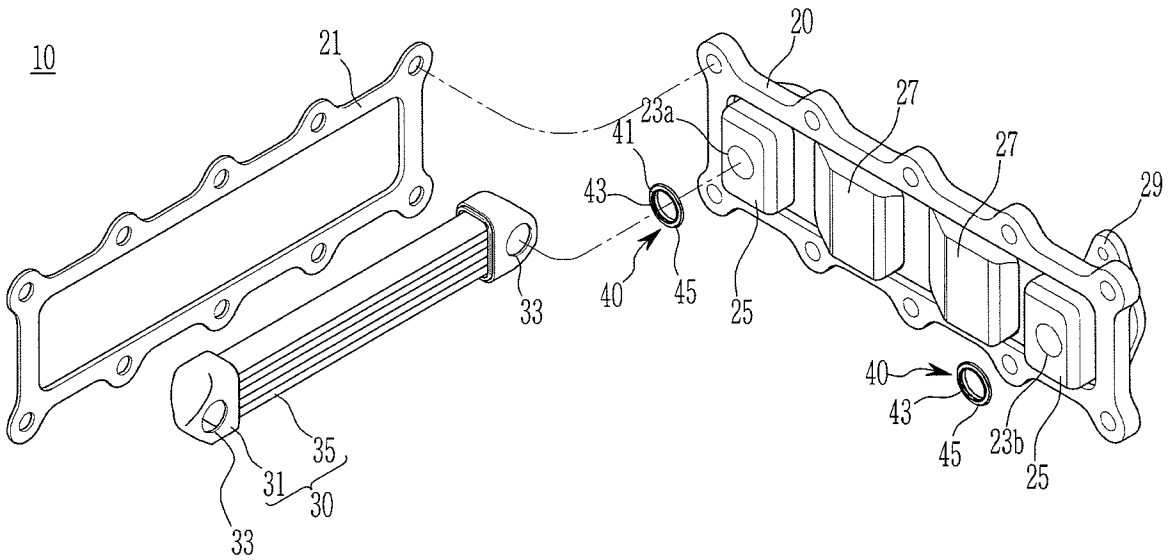
FIG. 3 is an exploded perspective view of an EGR cooler for a vehicle according to an exemplary embodiment of the present invention.
Figure 4:
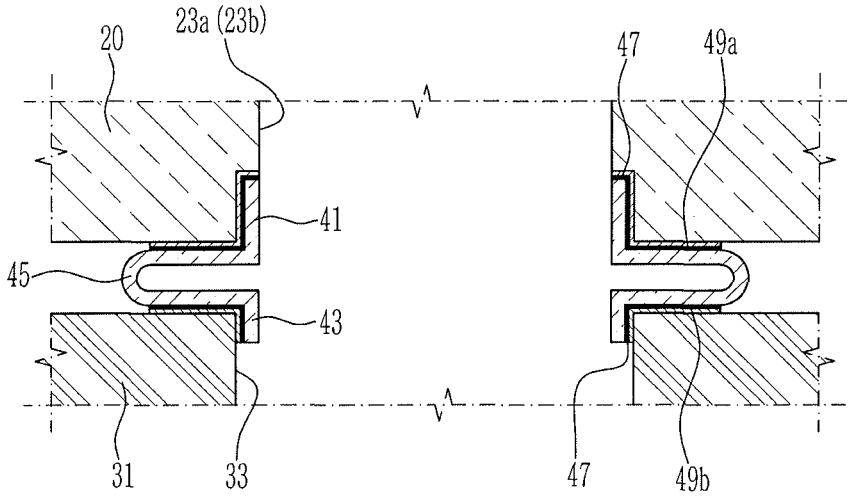
FIG. 4 is a schematic cross-sectional view showing a bonding of a connector applied to an EGR cooler for a vehicle according to an exemplary embodiment of the present invention.

FIG. 1 is a mounting perspective view of an EGR cooler for a vehicle according to an exemplary embodiment of the present invention, FIG. 2 is a schematic cross-sectional view of an EGR cooler for a vehicle according to an exemplary embodiment of the present invention, FIG. 3 is an exploded perspective view of an EGR cooler for a vehicle according to an exemplary embodiment of the present invention, and FIG. 4 is a schematic cross-sectional view showing a bonding of a connector applied to an EGR cooler for a vehicle according to an exemplary embodiment of the present invention.

Referring to FIG. 1 and FIG. 2, an EGR cooler 19 for a vehicle according to an exemplary embodiment of the present invention are directed to providing a cooler for an exhaust gas recirculation (EGR) device cooling an exhaust gas recirculated from an exhaust line to an intake line among an exhaust system of an engine.

Also, the structure of the EGR cooler 10 according to an exemplary embodiment of the present invention may be applied to various exchangers.

The EGR cooler for the vehicle 10 in an exemplary embodiment of the present invention is mounted at one side of a cylinder block 1 of the vehicle.

That is, the EGR cooler 10 is mounted to a receiving space 13 inside a housing 11 that is integrally formed at a wall surface of one side of the cylinder block 1.

A coolant inflow hole 3*a* which is connected to the receiving space 13 and into which the cooling water of the cylinder block 1 flows is formed at one side wall surface of the cylinder block 1.

Also, a coolant exhaust hole 3*b* to which the cooling water flowing from the coolant inflow hole 3*a* to the receiving space 13 is exhausted is formed at one side of the housing 11.

Referring to FIG. 3, the EGR cooler 10 includes a cover plate 20, a core 30, and a connector 40.

The cover plate 20 is formed of a plate shape to close the receiving space 13.

The cover plate 20 is mounted to the housing 11 and a gasket 21 is located between the housing 11 and the cover plate 20 to be watertight.

Also, in the cover plate 20, an exhaust gas outflow hole 23*a* and an exhaust gas inflow hole 23*b* are respectively formed at both sides.

In the cover plate 20, a plain end portion 25 is formed to be protruded at both sides of an inside surface.

In the present cover plate 20, the exhaust gas inflow hole 23*a* and the exhaust gas outflow hole 23*b* are penetration-formed at the center of the plain end portion 25, whereby a cap 31 that will be described later is stably bonded.

Also, in the cover plate 20, a supporting end portion 27 supporting a tube 35 that will be described later is formed to be protruded inside.

In the cover plate 20, the plain end portion 25 is formed inside at both sides, and the supporting end portion 27 is formed between the plain end portions 25 of both sides. In the drawing, two supporting end portions 27 are formed to be protruded, but it is not limited thereto and an appropriate number of the supporting end portions 27 may be formed depending on a length of the tube 35.

Also, in the cover plate 20, a bracket 29 to which an exhaust gas pipe p is respectively connected is integrally formed corresponding to the exhaust gas inflow hole 23*a* and the exhaust gas outflow hole 23*b* on an outside surface.

The cover plate 20 may be formed of an aluminum material for a low weight, thereby preventing a corrosion phenomenon generated by the exhaust gas and the condensed water.

Also, the core 30 includes both side caps 31 and a plurality of tubes 35.

The cap 31 is disposed respectively corresponding to the exhaust gas inflow hole 23*a* and the exhaust gas outflow hole 23*b*.

In the cap 31, a penetration hole 33 connected to the exhaust gas inflow hole 23*a* and the exhaust gas outflow hole 23*b* is respectively formed.

The cap 31 includes a stainless material.

Also, the tubes 35 are disposed between both side caps 31 and an exhaust gas passage is formed inside by a plurality of layers connecting the caps 31 to each other.

These tubes 35 are configured to be overlapped in plural, thereby respectively forming the exhaust gas passages.

If the cover plate 20 of the aluminum material and the cap 31 of the stainless material are directly bonded as different materials, an excessive corrosion phenomenon may occur in the cover plate 20 by a galvanic corrosion due to a heterojunction.

The connector 40 is mounted to connect a penetration hole 33 of the cap 31 to each of the exhaust gas inflow hole 23*a* and the exhaust gas outflow hole 23*b* of the cover plate 20.

Referring to FIG. 4, the connector 40 includes a first pipe portion 41, a second pipe portion 43, and a flange portion 45.

The first pipe portion 41 is bonded to an internal circumference thereof in a state of being respectively inserted inside the exhaust gas inflow hole 23*a* and the exhaust gas outflow hole 23*b* of the cover plate 20.

The second pipe portion 43 is bonded to the internal circumference thereof in a state of being inserted into the penetration hole 33 of the cap 31.

Also, the flange portion 45 is located between the cover plate 20 and the cap 31.

The flange portion 45 integrally connects the first and second pipe parts 41 and 43 and is formed to have an external diameter greater than the external diameter of the first and second pipe parts 41 and 43.

Here, the connector 40 is bonded with the cover plate 20 and the cap 31 through a braze process.

In detail, a nickel-zinc (Ni—Zn) alloy 47 is plated on an external surface of the connector 40.

This is to prevent compounds between metals from being diffused during the braze process.

An aluminum filler metal 49*a* is coated on the external circumference of the first pipe portion 41 in contact with the cover plate 20 and the partial surface of the flange portion 45 in contact with the cover plate 20.

A nickel filler metal 49*b* is coated on the external circumference of the second pipe portion 43 in contact with the cap 31 and the partial surface of the flange portion 45 in contact with the cap 31.

The connector 40 is bonded through a primary braze process in a state of being inserted to the cap 31, next may be bonded through a secondary braze process in a state of being inserted to the cover plate 20.

Since a melting point of nickel is 1000-1500° C. and the melting point of aluminum is 500-700° C., the connector 40 in a state of being inserted into the cap 31 and being firstly welding-bonded through the nickel filler metal 49*b* is inserted into the cover plate 20 and is welding-bonded through an aluminum filler metal 49*a* by use of a relatively low temperature.

The connector 40 may include the stainless material.

Accordingly, in the EGR cooler 10 according to an exemplary embodiment of the present invention, the housing 11 is integrally formed at one side of the cylinder block 1 to be mounted, the low weight and the cost reduction are possible by reducing the occupied space in the engine compartment.

Also, for the low weight of the EGR cooler 10, the cover plate 20 is formed of the aluminum material and the connector 40 including the stainless material is applied to improve the problems such as the corrosion and the bonding.

That is, in the EGR cooler 10, the cover plate 20 is formed of the aluminum material for the low weight, to prevent the corrosion phenomenon generated by the exhaust gas and the condensed water at the bonding portion of the cover plate 20 and the cap 31 and the excessing corrosion phenomenon generated in the over plate 20 due to the galvanic corrosion by the heterojunction between the aluminum and the stainless material, the connector 40 including the stainless material is applied and the brazing bonding is executed. Accordingly, the portion of the cover plate 20 exposed from the exhaust gas and the condensed water may be minimized and the corrosion may be prevented, thereby absorbing an inside vibration by strengthening the bonding.

Also, in the EGR cooler 10 according to an exemplary embodiment of the present invention, as the bracket 29 for bonding the exhaust gas line is integrally formed at the cover plate 20, there are merits that the number of parts maybe reduced and the weight may be lighter.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the claims appended hereto and their equivalents.

What is claimed is:

1. An exhaust gas recirculation (EGR) cooler apparatus for a vehicle mounted at a receiving space formed on one side wall surface of a cylinder block of the vehicle, the apparatus comprising:

a housing forming the receiving space, wherein a coolant inflow hole and a coolant exhaust hole are respectively formed to the housing so that a coolant of the cylinder block flows in and out therethrough;

a cover plate mounted on the housing so as to close the receiving space, wherein an exhaust gas inflow hole and an exhaust gas outflow hole are respectively formed to the cover plate so that an exhaust gas flows in and out therethrough;

a core including side caps in which a penetration hole connected to the exhaust gas inflow hole and the exhaust gas outflow hole respectively in the receiving space and a tube connecting the side caps wherein the exhaust gas fluidically-communicates through the tube; and a connector respectively connecting the penetration hole of the side caps to the exhaust gas inflow hole and the exhaust gas outflow hole of the cover plate.

2. The EGR cooler apparatus for the vehicle of claim 1, wherein the cover plate is made of an aluminum material.

3. The EGR cooler apparatus for the vehicle of claim 1, wherein the cover plate is bonded with the side caps in a state that a plain end portion is formed to be protruded at first and second sides of an inner surface of the cover plate and the exhaust gas inflow hole and the exhaust gas outflow hole are formed to be penetrated at the plain end portion.

4. The EGR cooler apparatus for the vehicle of claim 1, wherein the side caps are mounted inside the cover plate, the penetration hole is respectively formed corresponding to the exhaust gas inflow hole and the exhaust gas outflow hole, and the tube is disposed between the side caps and made of a plurality of layers forming an exhaust gas passage therein.

5. The EGR cooler apparatus for the vehicle of claim 1, wherein the connector includes a first pipe portion respectively inserted in the exhaust gas inflow hole and the exhaust gas outflow hole of the cover plate respectively and bonded to an internal circumference thereof a second pipe portion inserted to the penetration hole of the side caps and bonded to an internal circumference thereof; and a flange portion integrally connecting the first and second pipe portions and interposed between the cover plate and the side caps.

6. The EGR cooler apparatus for the vehicle of claim 5, wherein the flange portion is formed to have an external diameter larger than an external diameter of the first and second pipe portions.

7. The EGR cooler apparatus for the vehicle of claim 5, wherein the connector is plated with a nickel-zinc (Ni—Zn) alloy on an external surface.

8. The EGR cooler apparatus for the vehicle of claim 7, wherein an aluminum filler metal is coated on an external circumference of the first pipe portion in contact with the cover plate and a partial surface of the flange portion in contact with the cover plate.

9. The EGR cooler apparatus for the vehicle of claim 7, wherein a nickel filler metal is coated on the external circumference of the second pipe portion in contact with the side caps and a partial surface of the flange portion in contact with the side caps.

10. The EGR cooler apparatus for the vehicle of claim 5, wherein the connector is welding-bonded with the cover plate and the side caps through a braze process.

11. An exhaust gas recirculation (EGR) cooler apparatus for a vehicle disposed at a receiving space formed on a side wall surface of a cylinder block of the vehicle, the apparatus comprising:

a housing forming the receiving space wherein a coolant inflow hole and a coolant exhaust hole are respectively formed to the housing, and wherein a coolant of the cylinder block flows into the housing through the coolant inflow hole and out of the housing through the coolant exhaust hole;

a cover plate mounted on the housing to close the receiving space wherein an exhaust gas inflow hole and an exhaust gas outflow hole are respectively formed to the housing and wherein an exhaust gas flows through the cover plate through the exhaust gas inflow hole and out of the cover plate through the exhaust gas outflow hole;

a core including:

first and second side caps disposed in the receiving space, wherein the first side cap includes a first penetration hole connected to the exhaust gas inflow hole and the first side cap includes a second penetration hole connected to the exhaust gas outflow hole;

a tube connected to the first and second side caps, wherein the exhaust gas fluidically-communicates between the first and second side caps through the tube; and a first connector connecting the first penetration hole of the first side cap to the exhaust gas inflow hole and a second connector connecting the second penetration hole of the second side cap to the exhaust gas outflow hole and of the cover plate.

12. The EGR cooler apparatus for the vehicle of claim 11, wherein the cover plate includes an aluminum material.

13. The EGR cooler apparatus for the vehicle of claim 11, wherein the cover plate is bonded with the first side cap in a state that a first plain end portion is formed to be protruded at a first side of an internal surface of the cover plate, wherein the cover plate is bonded with the second side cap in a state that a second plain end portion is formed to be protruded at a second side of the internal surface of the cover plate, and wherein the exhaust gas inflow hole and the exhaust gas outflow hole are formed to be penetrated at the first and second plain end portions of the cover plate, respectively.

14. The EGR cooler apparatus for the vehicle of claim 11, wherein the tube is disposed between the first and second side caps and including a plurality of layers forming an exhaust gas passage therein.

15. The EGR cooler apparatus for the vehicle of claim 11, wherein the first connector includes:

a first pipe portion of the first connector, wherein the first pipe portion of the first connector is bonded to an internal circumference of the exhaust gas inflow hole in a state of being inserted into the exhaust gas inflow hole of the cover plate; and a second pipe portion of the first connector, wherein the second pipe portion of the first connector is bonded to an internal circumference of the first penetration hole of the cap in a state of being inserted to the first penetration hole of the first side cap; and a flange portion of the first connector, wherein the flange of the first connector integrally connects the first and second pipe portions of the first connector and located between the cover plate and the first side cap.

16. The EGR cooler apparatus for the vehicle of claim 15, wherein the flange portion of the first connector is formed to have an external diameter greater than an external diameter of the first and second pipe portions of the first connector.

17. The EGR cooler apparatus for the vehicle of claim 15, wherein the second connector includes:

a first pipe portion of the second connector, wherein the first pipe portion of the second connector is bonded to an internal circumference of the exhaust gas outflow hole in a state of being inserted into the exhaust gas outflow hole of the cover plate;

a second pipe portion of the second connector, wherein the second pipe portion of the second connector is bonded to an internal circumference of the second penetration hole of the second side cap in a state of being inserted to the second penetration hole of the second side cap; and a flange portion of the second connector, wherein the flange portion of the second connector integrally connects the first and second pipe portions of the second connector and is located between the cover plate and the second side cap.

18. The EGR cooler apparatus for the vehicle of claim 17, wherein the flange portion of the second connector is formed to have an external diameter greater than an external diameter of the first and second pipe portions of the first connector.

19. The EGR cooler apparatus for the vehicle of claim 11, wherein the first and second connectors are plated with a nickel-zinc (Ni—Zn) alloy on an external surface thereof.

* * * * *